US005273667A

United States Patent [19]

Gill et al.

[11] Patent Number: 5,273,667

[45] Date of Patent: Dec. 28, 1993

[54] RECOVERY AND UTILIZATION OF PHOSPHATE SLUDGE

[76] Inventors: Colman A. Gill, 4155 Meadow Way, Bloomfield Hills, Mich. 48301; Catherine M. Berbiglia, 28062 E. Greenmeadow Cir., Farmington Hills, Mich. 48334

[21] Appl. No.: 757,950

[22] Filed: Sep. 12, 1991

[51] Int. Cl.[5] ..... C10M 103/06; C10M 105/04; C10M 109/00

[52] U.S. Cl. ..... 252/25; 72/42

[58] Field of Search ..... 252/25; 72/42

[56] References Cited

U.S. PATENT DOCUMENTS

| | | | |
|---|---|---|---|
| 154,130 | 8/1874 | Eggleston | 252/25 |
| 3,344,065 | 9/1967 | Gänsheimer | 252/25 |
| 3,650,686 | 3/1972 | Hudson et al. | 423/158 |
| 3,652,414 | 3/1972 | Bergeron | 252/26 |
| 3,653,875 | 4/1972 | Waters et al. | 75/419 |
| 4,204,925 | 5/1980 | Coll-Palagos | 204/130 |
| 4,968,360 | 11/1990 | Hosemann et al. | 148/253 |
| 4,986,977 | 1/1991 | Peters | 423/592 |

OTHER PUBLICATIONS

Waters, Recovery of Metals and Phosphates from Waste Phosphate Sludge, *Metal Finishing*, Aug. 1971, pp. 39–42.

Smalheer and Smith, Lubricant Additives, 1967.

*Primary Examiner*—Prince Willis, Jr.

*Assistant Examiner*—J. Silbermann

[57] ABSTRACT

A method for treating the phosphate sludge waste from phosphate conversion baths used in the metal forming and metal working industry is described whereby the phosphate sludge is completely converted into a lubricant additive which can be used in lubricant formulations for the metal forming and metal working industry as well as general purpose lubricants. By operation of this process, waste treatment and waste disposal problems associated with the phosphate sludge are essentially eliminated. Various dry-soap lubricant formulations, warm forming lubricant formulations, non-reactive lubricant formulations, and metal precoat formulations containing the recovered or recycled phosphate sludge additive are described. The lime normally contained in many of these lubricant formulations can be significantly reduced or essentially eliminated by using the recovered phosphate sludge additive of this invention, thereby resulting in improved lubricant formulations. The recovered phosphate sludge is especially useful as an Extreme Pressure Additive.

30 Claims, 1 Drawing Sheet

RECOVERY AND UTILIZATION OF PHOSPHATE SLUDGE

FIELD OF THE INVENTION

This invention relates to the recovery of sludge generated in phosphating metal treatment baths and the conversion of that sludge into a lubricant additive suitable for use in lubricant formulations designed for the metal treatment, metal forming, and industrial lubrication. The lubricant additives produced from the recovered phosphate sludge are especially useful in dry-soap lubricant formulations, warm forming lubricant formulations, and non-reactive lubricant formulations as well as in conventional oil and grease-type lubricants. The lubricant additives produced from the recovered phosphate sludge is particularly useful as an Extreme Pressure Additive. In addition to providing a method for using a waste product which presents difficult disposal problems, lubricant formulations containing the recovery phosphate sludge of this invention are, in many cases, superior to the currently available lubricant formulations used in the metal treatment and metal forming industry.

BACKGROUND OF THE INVENTION

Practically all metal articles in commerce today—ranging from simple nuts and bolts to automobile bodies and beyond—have been subject to some type of pretreatment to modify and improve the physical or chemical properties of the metal surfaces. Phosphating is the most widely used metal pretreatment processes. Zinc phosphating is the most widely used of the phosphating pretreatment processes, with iron phosphating and manganese phosphating being used less often.

The treatment of iron, steel, and other metals with zinc phosphate compounds has been used for decades, if not longer, to improve corrosion resistance, paint bonding, lubrication during metal forming operation, and electrical characteristics of the treated metal surfaces. Iron and manganese phosphate compounds have also been used for the treatment of such metal surfaces. These phosphate solutions chemically react with a metal surface to covert that surface into a crystalline phosphate coating. The phosphate coating imparts the desirable properties to the metal surface. Due to the chemical reactions involved, undesirable by-products (i.e., phosphate sludge) are formed in, and settle out of, the baths. Although the composition of the phosphate sludge will vary depending on the composition of the phosphating baths, the metals treated, and the treatment conditions, generally the phosphate sludge will contain significant portions of zinc primary phosphate, zinc tertiary phosphate, ferrous phosphate, ferric phosphate, and/or manganese phosphate. Such phosphate sludges are generally considered as hazardous waste materials under U.S. Environmental Protection Agency (EPA) regulations at 40 C.F.R. Part 261 and are, therefore, subject to strict regulation as to disposal. These waste materials must, therefore, either be subjected to approved waste treatment on site or trucked to an approved waste treatment facility. Generally, disposal of the phosphate sludge involves collecting the material, dewatering the sludge to reduce transportation costs, and transporting the dewatered sludge to an approved landfill. Considerable costs and environmental risks are involved in such treatment and disposal.

Recently, in U.S. Pat. No. 4,986,977, a method for treating the sludge formed in a zinc phosphate conversion bath was described whereby various compounds are recovered from the sludge material. In a preferred embodiment (illustrated in FIG. 2 of that patent), the sludge was first treated with an aqueous base at a pH of at least 10 whereby solid iron hydroxide was recovered from a first aqueous phase. This first aqueous phase was then treated with an alkaline earth meal base at a pH greater than 10 whereby solid metal phosphate was recovered from a second aqueous solution. This second aqueous phase was then treated with acid at a pH of 7 to 10 whereby solid zinc hydroxide was recovered from a third aqueous solution. This third aqueous solution is reported to contain "soluble alkali metal salts essentially free of phosphate ions." Although this process is an improvement over direct disposal of the phosphate sludge, it does not eliminate the waste disposal problem. In addition to the disposal of the third aqueous solution, the solid products collected may also contain at least small concentrations of toxic contaminants which may render the utilization or disposal of the solid products more difficult.

It would be desirable to provide a method by which phosphate sludge could be recycled and converted to a useful product in its entirety. It would be desirable to provide phosphate conversion bath processes where disposal of the phosphate sludge is not required or is at least significantly reduced. It would also be desirable to provide new lubricant additives and lubricant formulations for metal forming, metal working, and other lubrication operations. It would also be desirable to provide a new and effective Extreme Pressure Additive for such lubrication operations and system. This present invention achieves these objectives as fully described in this specification.

SUMMARY OF THE INVENTION

This invention relates to a process for treating phosphate sludge obtained from phosphate conversion baths by which the phosphate sludge can be recycled and converted into a useful lubricating product. The types of phosphate sludge which can be treated by the process of this invention include sludges from zinc phosphate conversion baths, iron phosphate conversion baths, and manganese phosphate conversion baths. Generally, phosphate sludges from zinc phosphate conversion baths are preferred. The entire volume of phosphate sludge is converted into a useful product (i.e., recovered or recycled phosphate sludge) so that costly and environmentally risky disposal of the phosphate sludge is not required. The recycled phosphate sludge produced by the process of this invention is a lubricant additive which can be incorporated into lubricant formulations designed for use in metal forming or metal working operations as well as general industrial lubrication applications. In many of these lubricant formulations, the recycled phosphate sludge of this invention can essentially replace lime and/or other components, often resulting in a lubricant formulations with superior properties. The lubricant additives of this invention are especially useful in dry soap lubricants, wet soap lubricants, warm forming lubricants, and non-reactive lubricants as well as oil- and grease-type lubricants. In addition, the lubricant additives of this invention are particularly useful as Extreme Pressure Additives.

The process of treating and converting phosphate sludge into a lubricant additive essentially involves drying and grinding the phosphate sludge into finely divided particles. More specifically, this process involves collecting the phosphate sludge, dewatering the collected sludge using, for example, a filtering process, drying the dewatered sludge at an elevated temperature to a moisture content of less than about 10 weight percent, and reducing the particle size of the dried sludge to less than about 20 mesh. The dried and ground recycled phosphate sludge has been found to be an excellent lubricant additive which is suitable for use in metal forming, metal working, and general lubrication applications.

One object of the present invention is to provide a method for recovering phosphate sludge in a form suitable for use in lubricant formulations for metal forming operations, said method comprising the following steps:

(1) collecting the phosphate sludge from a phosphating bath used for treating metal surfaces;
(2) removing water from the collected phosphate sludge;
(3) drying the material from step (2) to a moisture content of less than about 10 weight percent; and
(4) grinding the dried material to a particle size of less than about 20 mesh to obtain recovered phosphate sludge in a form suitable for use in lubricant formulations for metal forming operations.

Another object of the present invention is to provide a lubricant additive suitable for use in lubricant formulations for metal forming operation consisting essentially of recovered phosphate sludge where the recovered phosphate sludge is the dried and ground sludge material obtained from phosphating baths used for treating metal surfaces.

Another object of the present invention is to provide a lubricant formulation suitable for use in metal forming operations, said formulation containing at least 5 weight percent recovered phosphate sludge wherein the recovered phosphate sludge is dried and ground phosphate sludge from phosphate conversion baths used for treating metal surfaces. Such lubricant formulations include, for example, aluminum-based dry soap lubricants, calcium-based dry soap lubricants, sodium-based dry soap lubricants, warm forming lubricants, non-reactive lubricants, oil- and grease-type lubricants, and the like.

These and other objects will be apparent from a consideration of this specification, including the drawings and claims.

These figures are intended to illustrate the invention and not to limit the invention.

DESCRIPTION OF THE PREFERRED EMBODIMENTS

The present invention relates to a method of treating phosphate sludge whereby a useful product is obtained and a difficult disposal problem is eliminated or at least minimized. More specifically, this invention relates to a process for treating phosphate sludge obtained from zinc phosphate conversion baths, iron phosphate conversion baths, or manganese conversion baths by which the phosphate sludge is recycled and converted into a useful lubricating product or products. The entire volume of phosphate sludge is converted into a useful product (i.e., recovered or recycled phosphate sludge) so that costly and environmentally risky disposal of the phosphate sludge is no longer required.

The recycled phosphate sludge produced by the process of this invention is a lubricant additive which can be incorporated into lubricant formulations. In many of these lubricant formulations, the recycled phosphate sludge of this invention can essentially replace lime and/or other components, often resulting in a lubricant formulations with superior properties. The lubricant additives of this invention are especially useful in dry soap lubricants, warm forming lubricants, non-reactive lubricants, and general purpose lubricants.

The process of treating and converting phosphate sludge into a lubricant additive essentially involves drying and grinding the phosphate sludge into finely divided particles. More specifically, this process involves collecting the phosphate sludge, dewatering the collected sludge using, for example, a filtering or equivalent process to remove the bulk of the water present in the sludge, drying the dewatered sludge at an elevated temperature to a moisture content of less than about 10 weight percent, and reducing the particle size of the dried sludge to less than about 20 mesh. This dried and ground recycled phosphate sludge has been found to be an excellent lubricant and especially suitable for use in various metal forming or metal working applications.

Figure 1:
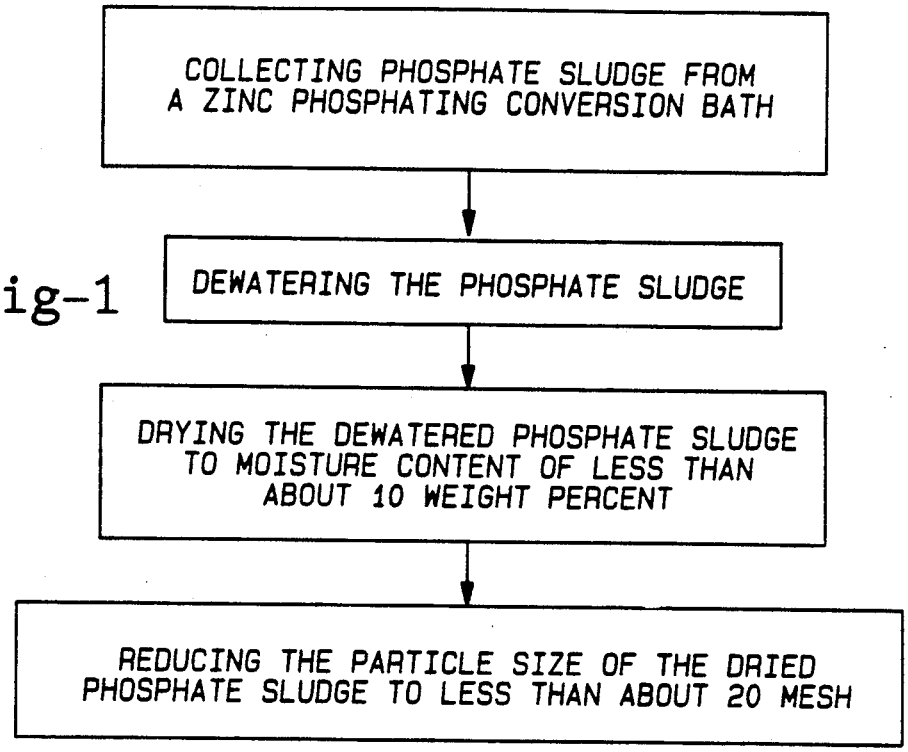
FIG. 1 is a flowchart illustrating the general process of treating phosphate sludge.

FIG. 1 shows the general procedure of the present invention using sludge from a zinc phosphate conversion process. Sludge from iron phosphate or manganese phosphate conversion baths can be treated in the same manner. Phosphate sludge from zinc phosphate conversion or treatment baths is first collected using conventional means. For example, the phosphating liquid can be decanted or drawn off and the sludge collected from the bottom of the bath. It is preferred, however, that concial-shaped phosphating baths or baths equipped with a settling cone are used in the actual phosphating process so that the sludge formed can settle to the bottom and then be easily pumped out. The sludge can be removed in a batch-type process or it can be removed in a continuous or semi-continuous process as it is formed. Other methods can be used to collect the sludge. As is apparent to one skilled in the art, the actual method of collecting the phosphate sludge is not critical. It is generally preferred, however, that the collection process remove the minimum amount of aqueous phase along with the sludge.

Once the phosphate sludge has been removed from the zinc phosphating bath, the material is dewatered to remove the bulk of the liquid content of the sludge. Conventional mechanical filtering means are generally suitable and are preferred. Filter presses or band filters are especially adapted for dewatering the phosphate sludge. In effect, the first two steps—collecting and dewatering—can be combined into a single step by pumping the phosphate sludge directly from the zinc phosphating bath to the dewatering unit (e.g., filter press or band filter). The purpose of the dewatering unit is to remove the bulk of the aqueous phase and, therefore, reduce the costs involved in the next drying step. Generally, the dewatering sludge will have a moisture content in the range of 20 to 50 weight percent. It is generally preferred that the moisture content of the dewatered sludge is below about 30 weight percent. The aqueous phase, along with its dissolved phosphating chemicals and components, can be returned to the phosphating bath to be reused.

The dewatered phosphate sludge is then dried to a moisture content of less than about 10 weight percent, preferably less than about 5 weight percent, and most preferably less than about 3 weight percent. The temperature at which the dewatered sludge is dried will typically be above about 180° F., preferably above about 190° F., and most preferably between about 190° and 220° F. Conventional drying equipment can be used. Although batch type drying equipment can be used, continuous type drying equipment may be preferred, especially where large quantities of phosphate sludge are treated. Suitable drying equipment includes convection dryers, conduction driers, microwave driers, infra-red or radiant heat driers, and the like. Driers utilizing a vacuum, such as vacuum extraction drying, may increase throughput and reduce oxidation of the recycled phosphate sludge. Drying the material in a non-oxidizing (i.e., an inert or reducing atmosphere) may also be beneficial because of reduced oxidation. Although a non-oxidizing atmosphere during drying is expected to be beneficial, such an atmosphere is not necessary. The product can, therefore, be dried under normal atmospheric conditions with good results.

Once the moisture content of the phosphate sludge has been reduced to the desired level, the dried material is ground to a particle size of less than about 20 mesh and preferably less than about 100 mesh. For some applications, even smaller particle sizes (e.g., less than about 325 mesh) may be preferred. Conventional grinding equipment can be used to obtain the desired particle size ranges. The recycled or recovered phosphate sludge is suitable for use as a lubricant additive or Extreme Pressure Additive for lubricating formulations and is especially useful for metal forming or metal shaping operations.

Figure 2:
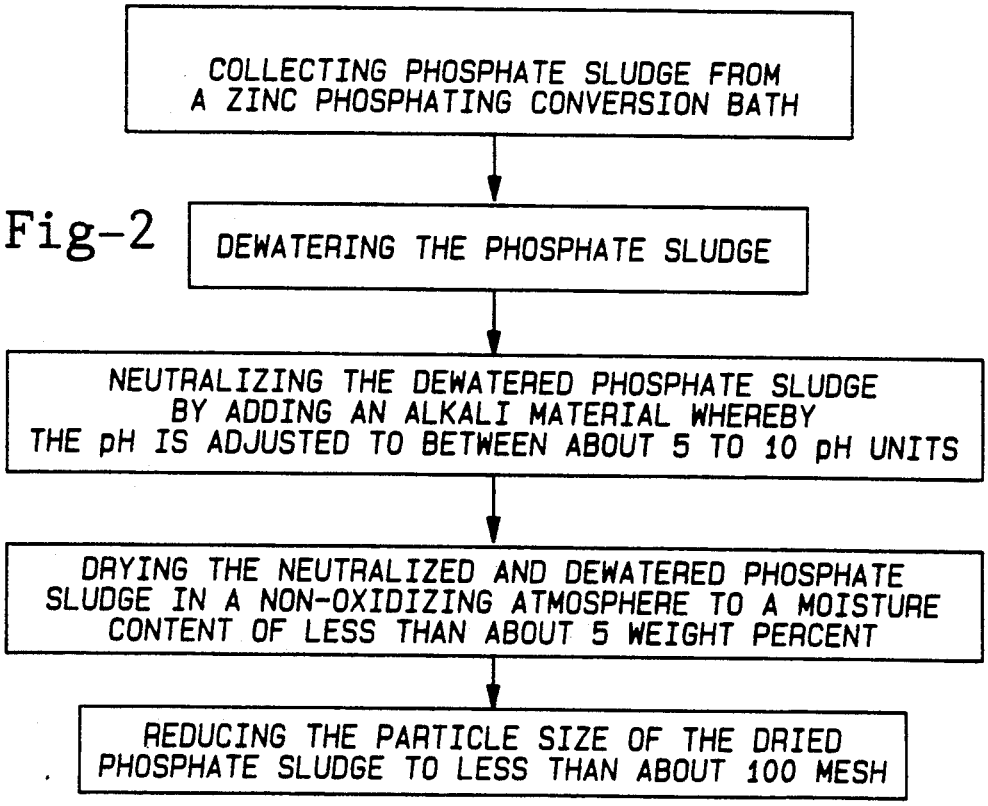
FIG. 2 is a flowchart illustrating a preferred embodiment of the process of treating phosphate sludge.

FIG. 2 illustrates a preferred embodiment of the process of this invention using phosphate sludge from a zinc phosphate conversion process as an example. As before, the process illustrated can be used to treat phosphate sludge from zinc phosphate conversion baths, iron phosphate conversion baths, and manganese phosphate conversion baths. Generally, sludge from zinc phosphate conversion baths are preferred. The first two steps illustrated in FIG. 2 are essentially the same as the first two steps of FIG. 1—namely, first collecting and then dewatering the phosphate sludge. The third step in FIG. 2 is an optional process step which involves neutralization of the phosphate sludge. Normally, the phosphate sludge from a zinc phosphate conversion bath is acidic with a pH of about 2. The dewatered phosphate sludge can be neutralized with organic or inorganic alkali materials. Suitable alkali materials include organic amines, soda ash, lime, borax, sodium hydroxide, calcium hydroxide, potassium hydroxide, and the like. When the phosphate sludge is neutralized it is generally preferred, as indicated in FIG. 2, that the pH be adjusted to between about 5 to 10 pH units. Neutralization is effected by merely blending the dewatered phosphate sludge with the appropriate amount of the desired alkali material. Although not illustrated in FIG. 2, the neutralization step, if desired, could be implemented at other stages of the process, as, for example, after the drying step or after the grinding step. If desired, however, the pH of the lubricant formulation containing recovered phosphate sludge can be adjusted to the desired level during the formulation process itself. This neutralization step can, if desired, be incorporated into the more general procedure of FIG. 1. It is generally preferred that the phosphate sludge is neutralized at some point during the process.

In FIG. 2, the neutralized and dewatered phosphate sludge is dried to a moisture content of less than about 5 weight percent in a non-oxidizing atmosphere. Conventional drying equipment, as discussed above, is suitable. It is generally preferred that enclosed dryers be used to facilitate the operation with a non-oxidizing atmosphere. The use of such an atmosphere is to minimize the oxidation of the components in the phosphate sludge and especially to minimize the oxidation of the ferrous phosphate contained in the sludge. Ferrous phosphate is an effective Extreme Pressure Additive and, thus, should be beneficial in many metal forming or metal working applications in which the lubricant additive of this invention may be used. Materials prepared under and exposed to normal atmospheric conditions and the normal oxygen levels found under such conditions still demonstrate good lubricating properties and, thus, are still useful as lubrication additives. Generally, however, strongly oxidizing conditions should be avoided during the process of this invention.

As again shown in FIG. 2, it is preferred that the final lubricant additive prepared by the process of this invention have a particle size of less than about 100 mesh. In some applications, even smaller particle sizes may be preferred. As noted above, conventional particle size reduction techniques and methods can be used to obtain the desired particle sizes. If desired, the finely-divided powder can be subjected to a size classifier whereby oversized particles can be returned to the grinder to be further reduced in size and undersized particles can be returned to an earlier stage of the process to be reprocessed. In this manner, powders of a particular particle size distribution can be obtained. In some applications, certain particle size distribution may be beneficial.

The recycled or recovered phosphate sludge produced by the process of this invention has surprising lubrication properties when incorporated into lubrication formulations designed for metal forming and metal working applications. The recycled or recovered phosphate sludge can be incorporated as a lubricant additive in many types of lubrication formulations, including, for example, dry soap lubricant formulations, warm forming lubricant formulations, non-reactive lubricant formulations, oil- and grease-type lubricants, and the like. Suitable dry-soap lubricant formulations include aluminum stearate-containing formulations, calcium stearate-containing formulations, sodium stearate-containing formulations, and oil-based dry-soap lubricant formulations. These formulations containing recycled or recovered phosphate sludge can be used in a wide array of metal forming or metal working applications including, for example, cold forming, cold heading, cold forming, warm forming, wire and bar drawing, tube drawing, deep drawing, stamping, metal extrusion, cold forging, warm forging, hot forging, and the like. Typically, these lubricant formulations are applied over a phosphate coating on the metal to be worked. In some instances, however, the lubricant formulations can be applied directly to the bare metal or pickled metal surfaces.

Preferred lubricant formulations include the dry-soap lubricants prepared with significant levels (i.e., greater than about 5 weight percent) of the recovered phosphate sludge of this invention. These dry-soap lubricants can be used to size and draw ferrous wire stock to produce a variety of products using conventional metal forming and metal working techniques. Lime is typically a common component of the conventional dry-soap lubricants and is normally used as a viscosity builder. The use of lime can result in a "dusty" product which may be hazardous if inhaled. (Calcium hydroxide has a TLV value of 5 mg/m$^3$.) The use of the recovered phosphate sludge of the present invention in place of lime (or at least significantly reducing the amount of lime needed) in such dry-soap lubricants can significantly reduce the dust problem. The reduction in dust results directly from the differences in the densities of the two components: hydrated lime has a bulk density of about 0.4 g/cc as compared to a bulk density of about 1.2 g/cc for the recovered phosphate sludge of the present invention. Replacing the lime in lubricant formulations with recovered phosphate sludge also makes cleaning of the parts or articles prepared in metal forming operations much easier. Parts prepared with lubricant formulations containing significant amounts of lime are generally cleaned with heavily chelated alkaline cleaners to remove the lime or a regular alkaline cleaner to remove residual stearate soap, followed by an acid wash to remove residual lime. The heavily chelated alkaline cleaner necessary with lime-containing formulations present significant waste disposal problems on its own. When the lime is replaced by recovered phosphate sludge, however, the cleaning procedure is considerably simplified in that cleaning can be accomplished using alkaline cleaner without added chelating compounds. The alkaline cleaners used in such cases do not present significant waste disposal problems. The recovered phosphate sludge of the present invention can also be used to replace or significantly reduce the borax (a polishing agent/lubricant) or sulfur (Extreme Pressure Additive) often found in dry-soap lubricant formulations.

A typical aluminum-based dry-soap lubricant formulation of the present invention contains the following components:

20 to 90 weight percent aluminum stearate;
5 to 30 weight percent recovered phosphate sludge;
0 to 40 weight percent calcium stearate;
0 to 60 weight percent zinc stearate;
0 to 70 weight percent lime;
0 to 15 weight percent molybdenum disulfide;
0 to 20 weight percent graphite; and
0 to 20 weight percent sodium stearate.

As noted above, it is generally preferred that the recovered phosphate sludge essentially replace the lime in such formulations. If desired, however, lime can be included. The basic components and composition of such an aluminum-based dry-soap lubricant formulation include aluminum stearate (65 to 90 weight percent), recovered phosphate sludge (5 to 30 weight percent), and sodium stearate (1 to 5 weight percent). Other components can be added for specific applications and properties based on their well know uses in the art.

A typical sodium-based dry-soap lubricant formulation of the present invention contains the following components:

40 to 90 weight percent fatty acid;
5 to 60 weight percent recovered phosphate sludge;
5 to 15 weight percent caustic soda;
0 to 50 weight percent lime;
0 to 40 weight percent borax;
0 to 30 weight percent soda ash;
0 to 10 weight percent molybdenum disulfide;
0 to 10 weight percent graphite;
0 to 3 weight percent sulfur;
0 to 10 weight percent iron oxide; and
0 to 10 weight percent titanium dioxide.

Suitable fatty acids include long chain monobasic organic acids such as oleic acid, palmitic acid, stearate acid, and the like. As noted above, it is generally preferred that the recovered phosphate sludge essentially replace the lime in such formulations. If desired, however, lime can be included. In this sodium-based dry-soap formulation the recovered phosphate sludge can also, if desired, replace the borax, iron oxide, titanium dioxide, sulfur, graphite, molybdenum disulfide, and soda ash in full or in part, depending on the application. The basic components and composition of such a sodium-based dry-soap lubricant formulation include fatty acids (40 to 90 weight percent), recovered phosphate sludge (5 to 50 weight percent), and caustic soda (5 to 15 weight percent). Other components can be added for specific applications and properties based on their well known uses in the art.

A typical calcium-based dry-soap lubricant formulation of the present invention contains the following components:

30 to 85 weight percent fatty acid;
5 to 65 weight percent recovered phosphate sludge;
5 to 15 weight percent lime;
0 to 50 weight percent fat;
0 to 10 weight percent caustic soda;
0 to 25 weight percent borax;
0 to 10 weight percent molybdenum disulfide;
0 to 30 weight percent graphite;
0 to 10 weight percent sulfur; and
0 to 20 weight percent titanium dioxide.

Suitable fatty acids include long chain monobasic organic acids such as oleic acid, palmitic acid, stearate acid, and the like. Although, as noted above, it is generally preferred that the recovered phosphate sludge essentially replace the lime in such formulations, the calcium-based dry soaps require lime. However, the incorporation of recovered phosphate sludge allows the amount of lime to be significantly reduced relative to calcium-based dry soaps without the recovered phosphate sludge. In this calcium-based dry-soap formulation the recovered phosphate sludge can also, if desired, replace or significantly reduce the amounts of the borax, titanium dioxide, and sulfur, depending on the application. The basic components and composition of such a calcium-based, dry-soap lubricant formulation include fatty acids (30 to 85 weight percent), recovered phosphate sludge (5 to 65 weight percent), and lime (5 to 15 weight percent). Other components can be added for specific applications and properties based on their well know uses in the art.

Other lubricant formulations for metal forming or metal working applications can also be prepared using the recovered phosphate sludge of this invention. Such lubricant formulations include, for example, warm forming lubricant formulations, hot forging lubricant formulations, and non-reactive lubricant formulations. Warm forming lubricant formulations are liquid dispersions contained in a synthetic or oil base or, more preferably, in an aqueous base. These formulations are applied by either immersion of the metal part or piece in the liquid or by spraying the dispersion directly on the part or piece. Warm forming lubricants are used to form aluminum, copper-based alloys, or steel which has been preheated to softened the metal prior to forming; preheated temperatures typically range from 200° to 1800°

F. depending on the metal and severity of the extrusion. The heat stability and extreme pressure properties of the recovered phosphate sludge of this invention are ideally suited for use in such formulations. A typical warm forming lubricant formulation containing recovered phosphate sludge of the present invention includes the following components:

15 to 30 weight percent fat;
5 to 30 weight percent recovered phosphate sludge;
0 to 10 weight percent borax;
0 to 10 weight percent titanium dioxide;
0 to 10 weight percent talc;
0 to 10 weight percent mica;
1 to 5 weight percent viscosity builder;
1 to 5 weight percent emulsifier;
1 to 5 weight percent surfactant; and
solvent as the balance.

Generally, the preferred solvent is water. When the lubricant formulation is applied by spraying it will generally be preferred that the particle size of the dispersed components be less than about 325 mesh. These smaller particle sizes can be obtained by milling the solid, blended components using conventional techniques.

As noted above, the recovered phosphate sludge of this invention can also be used in non-reactive lubricant formulations. Such lubricant formulations are typically applied by dipping the metal to be treated in an aqueous dispersion of the lubricant. The lubricant forms an adherent layer on the bare metal surface or on any precoat used. These lubricants are generally used to cold form ferrous metals but can also be used to cold form stainless steel, aluminum, and other non-ferrous metals. A typical non-reactive lubricant formulation of the present invention contains the following components dispersed in an aqueous medium:

10 to 90 weight percent metal stearates;
5 to 80 weight percent recovered phosphate sludge;
0 to 80 weight percent borax;
0 to 80 weight percent of sodium phosphate or potassium phosphate;
0 to 50 weight percent of sodium silicate or potassium silicate;
0 to 2 weight percent corrosion inhibitor; and
1 to 5 weight percent surfactant;

where the percentages are based on the dry components only. Suitable metal stearates include zinc stearate, aluminum stearate, magnesium stearate, calcium stearate, barium stearate, lithium stearate, sodium stearate, potassium stearate, or combinations thereof. The corrosion inhibitors and surfactants useful in these formulations are those normally used in conventional non-reactive lubricant formulations without added recovered phosphate sludge and are well know in the art.

In addition to the lubricant formulations described above, the recovered phosphate sludge of this invention can be incorporated into other lubricant formulations or other formulations designed for use in metal forming or metal working applications. For example, the recovered phosphate sludge can be used to replace all or at least a significant amount of the lime found in some precoat formulations. Slurries of lime are typically used to precoat steel and sometimes aluminum in order to form a carrier for dry-soap or non-reactive lubricants. A typical slurry precoat formulation using recovered phosphate sludge of this invention might consist of 0 to 10 weight percent lime, 5 to 15 weight percent recovered phosphate sludge, and 0 to 1 weight percent of a suitable dispersant in water.

The above lubricant formulations incorporate the recovered phosphate sludge directly as obtained from the process of this invention. It is not necessary, therefore, to separate out or remove the various components found in the phosphate sludge. Using the process of this invention the entire phosphate sludge produced in zinc phosphating baths—before this invention a waste product with significant and severe disposal problems—is converted into a valuable lubricant or lubricant component with essentially no waste. The process of this invention can, therefore, essentially eliminate the waste treatment and waste disposal associated with many phosphating processes. This process has significant advantages over a waste treatment process whereby the various components are separated and individually used as byproducts. These advantages include, for example, a much simpler and less costly process requiring fewer process steps, utilization of the entire phosphate sludge byproducts, and the virtual elimination of the waste treatment and waste disposal problems associated with the sludge from phosphating conversion baths and processes. In addition, the recovered phosphate sludge allows the elimination of lime in many conventional lubricant formulations used in the metal forming or metal working industry. The lubricant formulations prepared with recovered phosphate sludge have excellent lubricating properties and are, in most cases, superior to the conventional lubricants available.

The following examples are intended to illustrate the invention and are not intended to limit it. Unless otherwise noted, all percentages in the following examples are by weight.

EXAMPLE 1

Approximately 200 kg of phosphate sludge was collected from a zinc phosphate conversion bath used to treat steel. The moisture content was approximately 40 percent. The phosphate sludge was dewatered using a press-type filter to remove the bulk water and then dried and ground at 220° F. for 2 hours in a ribbon blender under ambient atmosphere to a moisture content of about 5 percent. The following particle size distribution was observed:

| | |
|---|---|
| 20 mesh | 2.5% |
| 40 mesh | 24.5% |
| 60 mesh | 46.5% |
| 80 mesh | 16.1% |
| 100 mesh | 3.4% |
| <100 mesh | 7.2% |

The dried and ground (i.e., recovered) phosphate sludge was then incorporated into the following lubricant formulation:

20 percent S.U.S. oil;
55 percent lime;
15 percent recovered phosphate sludge; and
10 percent soap chips.

The blended lubricant was essentially non-dusty. For comparison purposes, a conventional lubricant formulation was prepared as follows:

20 percent S.U.S. oil;
70 percent lime; and
10 percent soap chips.

These formulations were used to draw low-carbon steel wire through five 20 percent reductions at about 1000 ft/min using a standard Vaughan wire drawing machine. Although both lubricant formulation provided adequate lubrication for the operation, the formulation containing recovered phosphate sludge was superior. The temperature was measured at the exit zone of the die using a pyrometer. With the conventional formulation, the exit temperature was about 160° to 170° F. With the recovered phosphate sludge-containing formulation, the exit temperature was consistently 20° to 30° F. lower, indicating a significant increase in lubricant effectiveness. Estimates indicate that die lifetimes should be increased by a factor of 2 to 3 using the recovered sludge formulation.

EXAMPLE 2

The recovered phosphate sludge of Example 1 was incorporated into aluminum stearate-based lubricants. The following lubricant formulations were prepared:

| | Lubricant I | Lubricant II | Lubricant III |
|---|---|---|---|
| Aluminum stearate | 50% | 33% | 50% |
| Hydrated lime | 50% | 33% | — |
| Recovered phosphate sludge | — | 34% | 50% |

Lubricant I is included for comparison purposes only. The three formulations were used in a cold heading operation. The die temperature when Lubricant II was used was reduced about 30° F. as compared to the same operation using Lubricant I. The die lifetime was also significantly increased using Lubricant II over that observed using Lubricant I.

Lubricant III was prepared by replacing all of the lime with recovered phosphate sludge. Lubricant III had excellent lubricating characteristics in a wire drawing operation similar to that described in Example 1. If anything, in this particular application, the lubrication was too good as there was excess residual lubricant on the metal surface after drawing. Lubricant III would be expected to be ideally suited for more extreme and demanding metal working operations. The comparison between Lubricants II and III illustrates that lubricant formulations can be prepared with the recovered phosphate sludge having different lubricating characteristics depending on the intended application.

EXAMPLE 3

A similar recovered phosphate sludge material as described in Example 1 was added to a proprietary sodium stearate lubricant used for rod and bar drawing applications. The sodium stearate lubricant contained, as its major ingredients, sodium stearate, borax, and lime. Sufficient recovered phosphate sludge was added to this formulation to reduce the lime content by an estimated one-half. A significant reduction in the exit die temperatures was observed using the recovered phosphate sludge-containing material relative to the conventional lubricant.

That which is claimed is:

1. A lubricant formulation suitable for use in metal forming operations, wherein said lubricant formulation is an aluminum-based dry-soap lubricant comprising (1) 20 to 90 weight percent aluminum stearate;
(2) 5 to 30 weight percent recovered phosphate sludge;
(3) 0 to 40 weight percent calcium stearate;
(4) 0 to 60 weight percent zinc stearate;
(5) 0 to 70 weight percent lime;
(6) 0 to 15 weight percent molybdenum disulfide;
(7) 0 to 20 weight percent graphite; and
(8) 0 to 20 weight percent sodium stearate;

wherein the recovered phosphate sludge is dried and ground sludge from a phosphate conversion bath used for treating metal surfaces.

2. A lubricant formulation as defined in claim 1, wherein the phosphate conversion bath is a zinc phosphate conversion bath.

3. A lubricant formulation as defined in claim 1, wherein the recovered phosphate sludge is prepared by the method comprising the following steps:

(1) collecting phosphate sludge from a phosphate conversion bath used for treating metal surfaces;
(2) removing wafer from the collected phosphate sludge;
(3) drying the material from step (2) to a moisture content of less than about 10 weight percent; and
(4) grinding the dried material to a particle size of less than about 20 mesh to obtain recovered phosphate sludge.

4. A lubricant formulation as defined in claim 3 which contains (1) 65 to 90 weight percent aluminum stearate;
(2) 10 to 30 weight percent recovered phosphate sludge; and
(3) 1 to 5 weight percent sodium stearate.

5. A lubricant formulation as defined in claim 3, wherein the phosphate sludge is neutralized with an alkali material.

6. A lubricant formulation as defined in claim 3, wherein the phosphate conversion bath is a zinc phosphate conversion bath.

7. A lubricant formulation suitable for use in metal forming operations, wherein said lubricant formulation is a sodium-based dry-soap lubricant comprising (1) 40 to 90 weight percent fatty acid;
(2) 5 to 60 weight percent recovered phosphate sludge;
(3) 5 to 15 weight percent caustic soda;
(4) 0 to 50 weight percent lime;
(5) 0 to 40 weight percent borax;
(6) 0 to 30 weight percent soda ash;
(7) 0 to 10 weight percent molybdenum disulfide;
(8) 0 to 10 weight percent graphite;
(9) 0 to 3 weight percent sulfur;
(10) 0 to 10 weight percent iron oxide; and
(11) 0 to 10 weight percent titanium dioxide;

wherein the recovered phosphate sludge is dried and ground sludge from a phosphate conversion bath used for treating metal surfaces.

8. A lubricant formulation as defined in claim 7, wherein the phosphate conversion bath is a zinc phosphate conversion bath.

9. A lubricant formulation as defined in claim 7, wherein the recovered phosphate sludge is prepared by the method comprising the following steps:

(1) collecting phosphate sludge from a phosphate conversion bath used for treating metal surfaces;
(2) removing water from the collected phosphate sludge;
(3) drying the material from step (2) to a moisture content of less than about 10 weight percent; and
(4) grinding the dried material to a particle size of less than about 20 mesh to obtain recovered phosphate sludge.

10. A lubricant formulation as defined in claim 9 which contains
(1) 40 to 90 weight percent fatty acid;
(2) 5 to 50 weight percent recovered phosphate sludge; and
(3) 5 to 15 weight percent caustic soda.

11. A lubricant formulation as defined in claim 9, wherein the phosphate sludge is neutralized with an alkali material.

12. A lubricant formulation as defined in claim 9, wherein the phosphate conversion bath is a zinc phosphate conversion bath.

13. A lubricant formulation suitable for use in metal forming operations, wherein said lubricant formulation is a calcium-based dry-soap lubricant comprising
(1) 30 to 85 weight percent fatty acid;
(2) 5 to 65 weight percent recovered phosphate sludge;
(3) 5 to 15 weight percent lime;
(4) 0 to 50 weight percent fat;
(5) 0 to 10 weight percent caustic soda;
(6) 0 to 25 weight percent borax;
(7) 0 to 10 weight percent molybdenum disulfide;
(8) 0 to 30 weight percent graphite;
(9) 0 to 10 weight percent sulfur; and
(10) 0 to 20 weight percent titanium dioxide;
wherein the recovered phosphate sludge is dried and ground sludge from a phosphate conversion bath used for treating metal surfaces.

14. A lubricant formulation as defined in claim 13, wherein the phosphate conversion bath is a zinc phosphate conversion bath.

15. A lubricant formulation as defined in claim 13, wherein the recovered phosphate sludge is prepared by the method comprising the following steps:
(1) collecting phosphate sludge from a phosphate conversion bath used for treating metal surfaces;
(2) removing water from the collected phosphate sludge;
(3) drying the material from step (2) to a moisture content of less than about 10 weight percent; and
(4) grinding the dried material to a particle size of less than about 20 mesh to obtain recovered phosphate sludge.

16. A lubricant formulation as defined in claim 15 which contains
(1) 30 to 85 weight percent fatty acid, wherein the fatty acid is a long chain monobasic organic acid;
(2) 5 to 65 weight percent recovered phosphate sludge; and
(3) 5 to 15 weight percent lime.

17. A lubricant formulation as defined in claim 15, wherein the phosphate sludge is neutralized with an alkali material.

18. A lubricant formulation as defined in claim 15, wherein the phosphate conversion bath is a zinc phosphate conversion bath.

19. A lubricant formulation suitable for use in metal forming operations, wherein said lubricant formulation is a warm forming lubricant formulation comprising
(1) 15 to 30 weight percent fat;
(2) 5 to 30 weight percent recovered phosphate sludge;
(3) 0 to 10 weight percent borax;
(4) 0 to 10 weight percent titanium dioxide;
(5) 0 to 10 weight percent caustic talc;
(6) 0 to 10 weight percent mica;
(7) 1 to 5 weight percent viscosity builder;
(8) 1 to 5 weight percent emulsifier;
(9) 1 to 5 weight percent surfactant; and
(10) solvent as the balance;
wherein the recovered phosphate sludge is dried and ground sludge from a phosphate conversion bath used for treating metal surfaces.

20. A lubricant formulation as defined in claim 19, wherein the phosphate conversion bath is a zinc phosphate conversion bath.

21. A lubricant formulation as defined in claim 19, wherein the recovered phosphate sludge is prepared by the method comprising the following steps:
(1) collecting phosphate sludge from a phosphate conversion bath used for treating metal surfaces;
(2) removing water from the collected phosphate sludge;
(3) drying the material from step (2) to a moisture content of less than about 10 weight percent; and
(4) grinding the dried material to a particle size of less than about 20 mesh to obtain recovered phosphate sludge.

22. A lubricant formulation as defined in claim 21, wherein the solvent is water and the particle size of the formulation is less than about 100 mesh.

23. A lubricant formulation as defined in claim 21, wherein the phosphate sludge is neutralized with an alkali material.

24. A lubricant formulation as defined in claim 21, wherein the phosphate conversion bath is a zinc phosphate conversion bath.

25. A lubricant formulation suitable for use in metal forming operations, wherein said lubricant formulation is a non-reactive lubricant formulation comprising
(1) 10 to 90 weight percent metal stearates;
(2) 5 to 80 weight percent recovered phosphate sludge;
(3) 0 to 80 weight percent borax;
(4) 0 to 80 weight percent of sodium phosphate or potassium phosphate;
(5) 0 to 50 weight percent of sodium silicate or potassium silicate;
(6) 0 to 2 weight percent corrosion inhibitor; and
(7) 1 to 5 weight percent surfactant;
in an aqueous dispersion; wherein the recovered phosphate sludge is dried and ground sludge from a phosphate conversion bath used for treating metal surfaces.

26. A lubricant formulation as defined in claim 25, wherein the phosphate conversion bath is a zinc phosphate conversion bath.

27. A lubricant formulation as defined in claim 25, wherein the recovered phosphate sludge is prepared by the method comprising the following steps:
(1) collecting phosphate sludge from a phosphate conversion bath used for treating metal surfaces;
(2) removing water from the collected phosphate sludge;
(3) drying the material from step (2) to a moisture content of less than about 10 weight percent; and
(4) grinding the dried material to a particle size of less than about 20 mesh to obtain recovered phosphate sludge.

28. A lubricant formulation as defined in claim 27, wherein the metal stearate is zinc stearate, aluminum stearate, magnesium stearate, calcium stearate, barium stearate, lithium stearate, sodium stearate, potassium stearate, or combinations thereof.

29. A lubricant formulation as defined in claim 27, wherein the phosphate sludge is neutralized with an alkali material.

30. A lubricant formulation as defined in claim 27, wherein the phosphate conversion bath is a zinc phosphate conversion bath.

* * * * *

UNITED STATES PATENT AND TRADEMARK OFFICE

CERTIFICATE OF CORRECTION

PATENT NO. : 5,273,667

DATED : December 28, 1993

INVENTOR(S) : Colman A. Gill and Catherine M. Berbiglia

It is certified that error appears in the above-identified patent and that said Letters Patent is hereby corrected as shown below:

Column 12, line 16, the word "wafer" should be --water--

Signed and Sealed this

Fifteenth Day of November, 1994

*Attest:*

Bruce Lehman

BRUCE LEHMAN

*Attesting Officer*

*Commissioner of Patents and Trademarks*